United States Patent [19]

Myers

[11] 4,309,599

[45] Jan. 5, 1982

[54] PACER DEVICE

[76] Inventor: Harold K. Myers, 5637 McLynn Ave., Montreal, Quebec, Canada, H3X 2P9

[21] Appl. No.: 100,868

[22] Filed: Dec. 6, 1979

[51] Int. Cl.[3] ..... G07C 1/22

[52] U.S. Cl. ..... 235/92 TF; 235/92 GA; 235/92 T

[58] Field of Search ..... 235/92 TF, 92 T, 92 FQ, 235/92 GA, 92 PB, 92 DN, 92 CA, 105; 368/2, 9, 10

[56] References Cited

U.S. PATENT DOCUMENTS

| | | | |
|---|---|---|---|
| 3,467,821 | 9/1969 | Arp | 235/92 TF |
| 3,714,645 | 1/1973 | Silvertson | 235/92 FQ |
| 3,797,010 | 3/1974 | Adler et al. | 235/92 FQ |
| 3,846,704 | 11/1974 | Bassette | 235/92 FQ |
| 4,112,926 | 9/1978 | Schulman et al. | 235/92 GA |
| 4,223,211 | 9/1980 | Allsen et al. | 235/92 DN |

*Primary Examiner*—Joseph M. Thesz

*Attorney, Agent, or Firm*—Fishman and Van Kirk

[57] ABSTRACT

The invention relates to an electronic device for measuring the time interval between the occurrence of any two successive ones of a plurality of similar events, specifically, the time interval between footsteps in jogging, running or walking, or the leg or arm motion associated with bicycling, rowing, swimming, cross-country skiing or the like, and for providing bio-feedback information to a user in the form of an alarm signal when: the measured interval is less than a predetermined low limit; the measured interval is greater than a predetermined high limit. The device includes a transducer for producing a signal at the detection of the occurrence of each event. The signals are fed to both a timing circuit and a detection circuit. The timing circuit measures the time interval between two successive events, and the detection circuit determines if the measured interval is between the high and low limits. If it is not, a signal is fed to an output circuit which then provides an audible alarm. The audible signal is different for a low interval than for a high interval. As a result of this bio-feedback information, the user can appropriately modify his behaviour.

5 Claims, 3 Drawing Figures

PACER DEVICE

BACKGROUND OF INVENTION (a) Field of the Invention

The invention relates to an electronic device for measuring the time interval between the occurrence of any two successive ones of a plurality of similar events, specifically, the time interval between footsteps in jogging, running or walking, or the leg or arm motion associated with bicycling, rowing, swimming, cross-country skiing, or the like. More specifically, the invention relates to such a device which provides bio-feedback information in the form of an alarm signal: if the measured interval is less than a predetermined low limit; or if the measured interval is greater than a predetermined high limit.

(b) Description of Prior Art

Although there are many timing devices known in the prior art, such as stop watches, etc., these devices time the interval between two dissimilar events, i.e., the start and finish of a race. In addition, there are known in the art pedometers which measure the distance walked by a user. Such pedometers are taught, for example, in U.S. Pat. Nos. 3,818,194, Biro, June 18, 1974, 4,019,030, Tamiz, Apr. 19, 1977; and 4,053,755, Sherrill, Oct. 11, 1977.

However, Applicant is not aware of any device which measures the time interval between the occurrence of two successive similar events, as above described, which provides an alarm signal if the second occurrence occurs too quickly or too long after the occurrence of the first occurrence. Such a device would be useful, inter alia, for joggers, runners, etc., who wish to pace themselves during practice or competition. The device is also useful for athletes who require bio-feedback information, i.e., a continuous indication of physical performance when engaged in rigorous activity, so that the athlete can appropriately modify his behaviour based on the information feedback.

SUMMARY OF THE INVENTION

It is therefore an object of the invention to provide a device for measuring the time interval between the occurrence of any two successive ones of a plurality of similar events. It is a further object of the invention to provide such a device which provides an alarm signal; if the measured interval is less than a predetermined low limit; or if the measured interval is greater than a predetermined high limit. In accordance with the invention there is provided an electronic device for measuring the time interval between the occurrence of any two successive ones of a plurality of similar events, specifically, the time interval between footsteps in jogging, running or walking, or the leg or arm motion associated with bicycling, rowing, swimming, cross-country skiing, or the like, and for providing bio-feedback information in the form of an alarm signal: if the measured interval is less than a predetermined low limit; or if the measured interval is greater than a predetermined high limit; said device comprising: transducer means for detecting the occurrence of each one of said events and for providing an output signal at each such detention; a timing circuit for measuring the time interval between the occurrence of two successive such events; a detection circuit for detecting whether the measured interval is less than said low limit or greater than said high limit; and an output circuit to provide an output signal when interval is less than said low limit or greater than said high limit.

Said timing circuit may comprise a two stable state device having a first period and a second period; said first period being equal to said low limit; the sum of said first period and said second period being equal to said high limit.

Said two stable state device preferably comprises a multivibrator, said first period being determined by a first timing circuit associated with a first half of the multivibrator, and said second period being determined by a second timing circuit associated with a second half of said multivibrator.

Said first and second timing circuits of said multivibrator comprise RC circuits, the R's of both circuits being adjustable; whereby said first and second periods are adjustable.

Said detection circuit may comprise a first D type flip-flop and a second D type flip-flop; each said flip-flop having a D terminal, a clock terminal and a reset terminal; an output of said first half of said multivibrator being fed to the D terminal of said first flip-flop; the inverse of said output of said first half of said multivibrator being fed to the D terminal of said second flip-flop; an ouput of said second half of said multivibrator being fed to the reset terminals of both flip-flops; and an output of said transducer means being fed to the clock terminals of both flip-flops and to an input terminal of the first half of said multivibrator.

Said output circuit may comprise a first Schmitt trigger and a second Schmitt trigger; the outputs of both triggers being connected to a speaker.

The output of said first flip-flop is connected to the input of said first trigger, and the output of said second flip-flop is connected to the input of said second trigger.

Each trigger has a timing circuit associated therewith; whereby each trigger, when triggered, will oscillate for a different period of time.

The device may also include a counter disposed, in circuit, between said transducer and said timing circuit; said counter being set to an nth count; whereby said device measures the time interval between the occurrence of successive nth events.

BRIEF DESCRIPTION OF DRAWINGS

The invention will be better understood by an examination of the following description, together with the accompanying drawings, in which.

DESCRIPTION OF PREFERRED EMBODIMENTS

The device herein comprises an electronic device which would, of course, be disposed in a housing unit as well known in the art. The housing unit is not shown or discussed herein except to mention that it must be small enough to be easily mounted on an athlete, and that it must conform with the requirements for electronic housing units, well known in the art.

Figure 1:
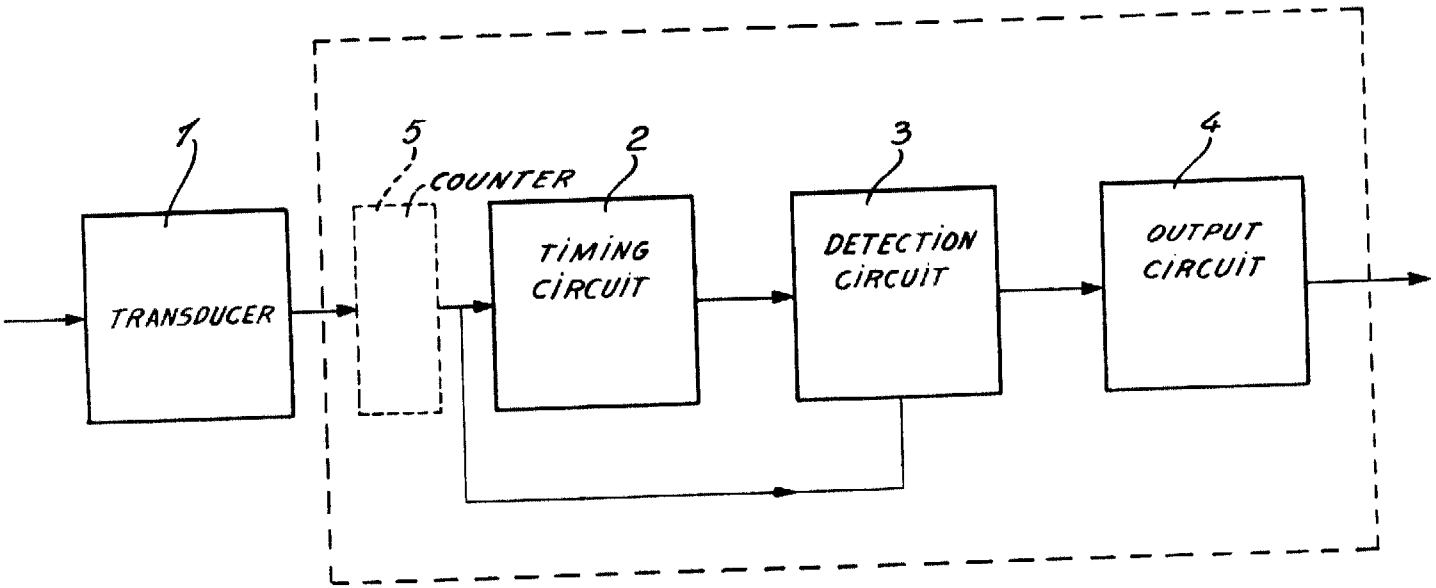
FIG. 1 is a block diagram of the inventive device.

Referring now to FIG. 1, the device herein comprises a transducer 1, a timing circuit 2, a detection circuit 3, and an output circuit 4. The transducer comprises any means for detecting the occurrence of each one of the plurality of similar events. For example, if the device is used to time the interval between the successive steps of a jogger, the transducer could be a pressure switch in the heels of joggers shoes which would be activated each time the jogger takes a step. In addition, the transducers shown in the above-mentioned patents could be used as the transducer herein. Any such transducer known in the art could be used in the present device.

The transducer provides an output each time it detects the occurrence of an event, and the output of the transducer is fed to both the timing circuit and the detection circuit. The timing circuit measures the time interval between the occurrence of two successive such events, and feeds an indication of same to the detection circuit. The detection circuit then detects whether the time interval is within predetermined limits. More specifically, it detects whether the time interval is less than a predetermined low limit or greater than a predetermined high limit. If the measured interval is outside of the predetermined limits, then the detection circuit will provide a signal to the output circuit which then provides an audible, or other, alarm signal. The device can be easily modified to provide an alarm only when one of the limits is violated. However, when the device provides a signal when either one of the limits is violated, then there will be a different signal for each of the limits, i.e., a short beep if the measured interval is less than the low limit and a long beep if it is greater than the high limit.

Figure 2:
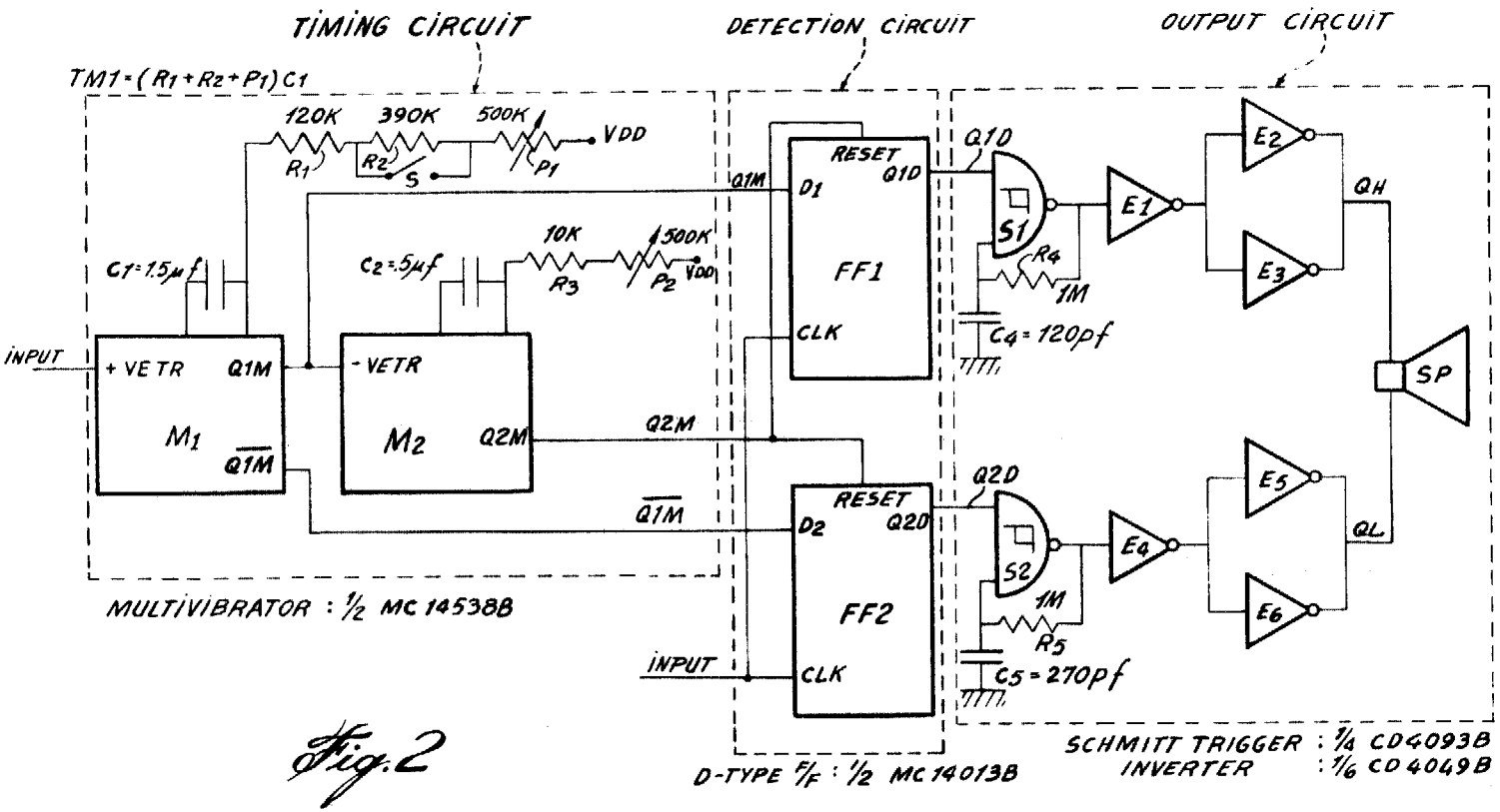
FIG. 2 is a more detailed schematic diagram of the inventive device.

Referring now to FIG. 2, the timing circuit comprises a multivibrator, and M1 and M2 each form a half of the multivibrator. Such multivibrators are, of course, readily available in chip form, and in one embodiment, the multivibrator comprises ½ MC14538B. The multivibrator has two periods, T1 and T2, determined, respectively, by circuitry associated with M1 and M2. The circuitry of M1 comprises capacitor C1, fixed resistor R1, resistor R2 with associated switch S, and potentiometer P1. Typical values for these elements are shown in the drawings. R2 and S are provided to change the period by an order of magnitude, while P1 is provided for fine adjustment. The period T1 comprises the low limit.

The circuitry of M2 comprises capacitor C2, fixed resistor R3 and potentiometer P2. T1 plus T2 is equal to the high limit, and the desirable time interval between two events is between T1 and T2, i.e. $T1+\frac{1}{2}T2$, in which case T2 is the "permissible error".

As seen in the drawings, M1 is triggered by a positive going input, while M2 is triggered by a negative going input. When M1 is triggered, it drives Q1M high for time T1. At all other times, $\overline{Q1M}$ is high. When M2 is triggered, it drives Q2M high for time T2. Q1M is connected to the negative trigger of M2.

The detection circuit comprises two D type flip-flops FF1 and FF2. Again, these are readily available in chip form, and in one embodiment, these comprise ½ MC14013B. Each of the flip flops includes a D terminal, a clock terminal (CLK) and an output terminal (Q1D and Q2D respectively). The D type flip-flop operates as follows: an output (high) is produced at the Q terminal only when the D terminal is high and then the flip-flop is clocked.

The Q1M output is connected to D1 and the $\overline{Q1M}$ is connected to D2. The Q2M output is connected to RESET terminals on both flip-flops. As is well known, when the reset terminal is high, the Q terminal is held low.

The output of the transducer is connected to both clock terminals, as well as to the input (positive trigger) of M1.

The detection circuit comprises two Schmitt triggers S1 and S2. Each Schmitt trigger includes a timing circuit (CR4R4 and C5R5 respectively) which is followed by a series of inverters E. The Schmitt triggers, in chip form, may comprise ¼ CD4093B, and the inverters, in chip form, may comprise 1/6 CD4049B. Q1D is connected to the trigger terminal of S1 and Q2D is connected to the trigger terminal of S2. As is well known, when the Schmitt trigger is triggered, it provides a series of oscillations for a period determined by the timing circuit. In the inventive device, the oscillations are at audio frequency, so that they will drive the speaker SP, through their respective inverters E, for a longer or shorter period of time depending on the values in the respective timing circuits.

Figure 3:
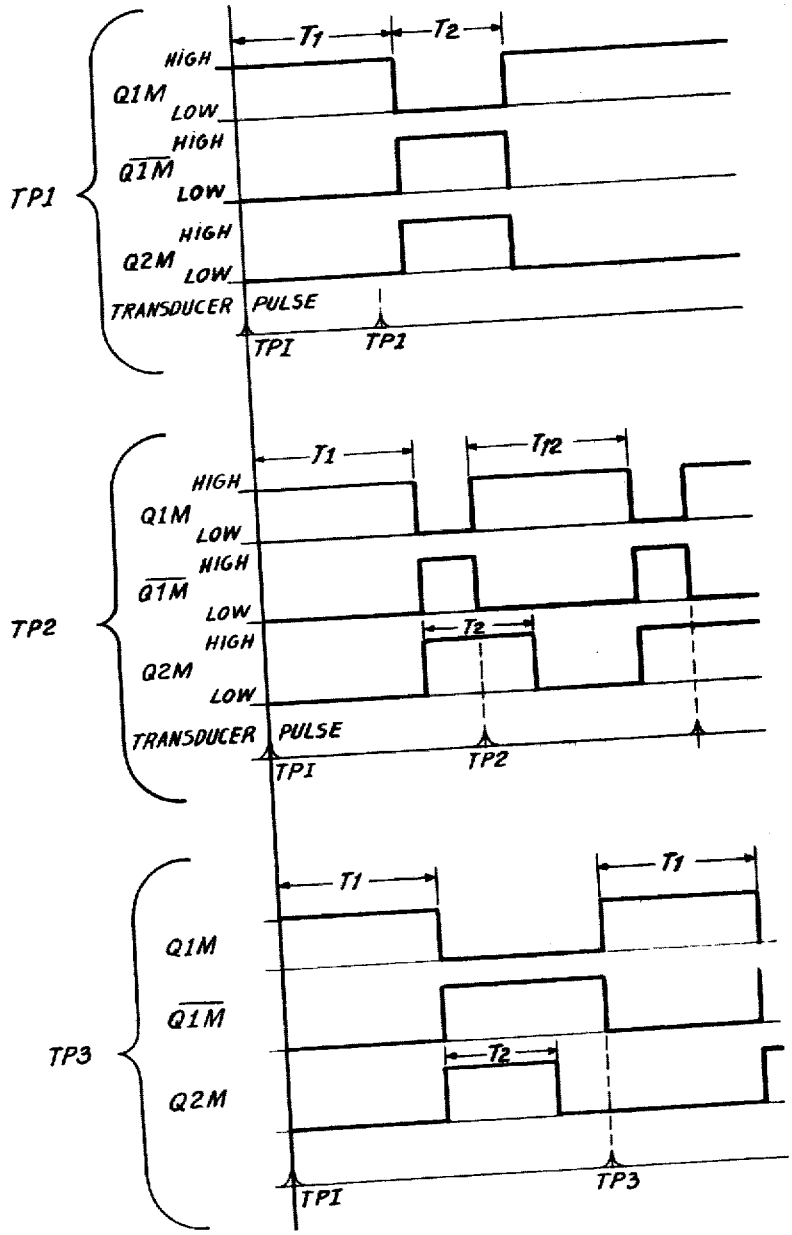
FIG. 3 illustrates graphs useful in understanding the operation of the inventive device.

For an explanation of how the device operates, reference is had to FIG. 3. As can be seen, the initial transducer input pulse, T1, sets Q1M high and $\overline{Q1M}$ low. Q2M is low and is not affected by the initial pulse.

We now consider three separate cases as follows:

TP1: The situation in which the second event occurs at a time less than the low limit.

TP2: The situation in which the second event occurs within the predetermined limits.

TP3: The situation in which the second event occurs at a time greater than the high limit.

Considering first TP2, as Q2M is high initially, the RESET terminals of both D flip-flops are held high, so that the Q terminals of both flip-flops are held low during the entire period T2. Accordingly, no matter what happens elsewhere, or, indeed, to the flip-flops themselves, there will not be any output from Q1D or Q2D, so that the Schmitt triggers will not be triggered, and there will not be any alarm output from the device.

In both TP1 and TP3, Q2M is low, so that both Q1D and Q2D can be driven high.

Returning now to TP2, as M1 is low when TP2 is applied to its trigger terminal, Q1M will be driven high, and $\overline{Q1M}$ low. M2 is not affected by this change in Q1M, and Q2M will remain high until the end of T2. It will then go high again at the end of T12, when Q1M goes low.

Turning now to the TP1 situation, at TP1, the D1 terminal of FF1 is high (as Q1M is high) and the D2 terminal of FF2 is low (as $\overline{Q1M}$ is low). The transducer pulse TP1 is applied to the clock terminals of both FF1 and FF2, however, as only D1 is high, only Q1D will be driven high to trigger S1 and drive the speaker SP for a period of time determined by the circuitry C4R4 associated with S1.

At TP1, as Q1M is already high, the input to M1 will not affect its output.

Turning now to the TP3 situation, just before TP3, Q1M is low and Q2M is low. $\overline{Q1M}$ is high. Thus, FF2 is in a state wherein Q2D can be driven high, but FF1 is not in a state wherein Q1D can be driven high.

The transducer pulse TP3 will be applied to M1 and to the clock terminals of FF1 and FF2 at the same time. Only after the pulse is applied to M1 will the state of M1 be changed. Thus, when the transducer pulse is applied to the clock terminals of the flip-flops, D1 will be low and D2 will be high. Accordingly, Q2D will be driven high to trigger S2 and drive speaker SP for a period of time determined by its circuitry C5R5.

It can thus be seen that, when the time between successive events falls within acceptable limits (TP2), there is no alarm signal. When it falls outside of these limits (TP1 and TP3), an alarm output is provided because S1 and S2, respectively, are triggered. As the timing circuitry of S1 and S2 are different, there will be different alarm signals for the different out of limit intervals.

The device as thus far described measures the time interval between two successive events. If it is desired to measure the interval between, say every two, three . . . n events, it would merely be necessary to insert a counter, as shown at 5 in dotted lines in FIG. 1, with the count set at the desired number (two, three . . . n), so that a pulse is supplied to the timing circuit and the detection circuit at every second, third . . . nth occurrence of the event. The remainder of the device works as above-described.

The bio-feedback information provided to a user of the device in accordance with the invention will provide signals to the user as to how he should modify his behaviour, i.e. run faster or slower, etc.

Although only a single embodiment was above-described, this was for the purpose of illustrating, but not limiting, the invention. Various modifications, which will come readily to the mind of one skilled in the art, are within the scope of the invention as defined in the appended claims.

I claim:

1. An electronic device for measuring the time interval between the occurrence of any two successive ones of a plurality of similar events, specificially, the time interval between footsteps in jogging, running, or walking, or the leg or arm motion associated with bicycling, rowing, swimming, cross-country skiing or the like, and for providing bio-feedback information in the form of an alarm signal: if the measured interval is less than a predetermined low limit; or if the measured interval is greater than a predetermined high limit;

said device comprising:

transducer means for detecting the occurrence of each one of said events and for providing an output signal at each such detection;

a timing circuit for measuring the time interval between the occurrence of two successive such events, the output signal of said transducer being fed to said timing circuit;

a detection circuit for detecting whether the measured interval is less than said low limit or greater than said high limit;

an output circuit to provide an output signal when interval is less than said low limit or greater than said high limit;

said timing circuit comprising a two state device having a first period and a second period;

said first period being equal to said low limit;

the sum of said first period and said second period being equal to said high limit;

said two state device comprising a multivibrator, said first period being determined by a first timing circuit associated with a first half of the multivibrator, and said second period being determined by a second timing circuit associated with a second half of said multivibrator;

said first and second timing circuits comprising RC circuits, the R's of both circuits being adjustable;

whereby said first and second periods are adjustable; and said detection circuit comprising a first D type flip-flop and a second D type flip-flop;

each said flip-flop having a D terminal, a clock terminal and a reset terminal;

an output of said first half of said multivibrator being fed to the D terminal of said first flip-flop;

the inverse of said output of said first half of said multivibrator being fed to the D terminal of said second flip-flop;

an output of said second half of said multivibrator being fed to the reset terminals of both flip-flops; and an output of said transducer means being fed to the clock terminals of both flip-flops and to an input terminal of the first half of said multivibrator.

2. A device as defined in claim 1 wherein said output circuit comprises a first Schmitt trigger and a second Schmitt trigger;

the outputs of both triggers being connected to a speaker.

3. A device as defined in claim 2 wherein the output of said first flip-flop is connected to the input of said first trigger, and wherein the output of said second flip-flop is connected to the input of said second trigger.

4. A device as defined in claim 3 wherein each trigger has a timing circuit associated therewith;

whereby each trigger, when triggered, will oscillate for a different period of time.

5. A device as defined in claim 4 and further including a counter disposed, in circuit, between said transducer and said timing circuit;

said counter being set to an nth count;

whereby said device measures the time interval between the occurrence of successive nth events.

* * * * *